US005906316A

United States Patent [19]

Gatzemeyer et al.

[11] Patent Number: 5,906,316

[45] Date of Patent: May 25, 1999

[54] NOZZLE TO DISPENSE ACTIVE MATERIAL

[75] Inventors: John J. Gatzemeyer, Caledonia; D James Musiel, Racine, both of Wis.; Allen M. Bartlo, West Helena, Ark.

[73] Assignee: S. C. Johnson & Son, Inc., Racine, Wis.

[21] Appl. No.: 08/923,726

[22] Filed: Sep. 4, 1997

[51] Int. Cl.[6] ..... B05B 7/26

[52] U.S. Cl. ..... 239/10; 239/315; 137/268

[58] Field of Search ..... 239/310, 313, 239/315–317, 10, 468, 417, 417.3, 491, 530, 533.13, 581.1; 137/268; 222/144.5, 145.6, 529; 422/261, 264, 292

[56] References Cited

U.S. PATENT DOCUMENTS

| | | | |
|---|---|---|---|
| 165,773 | 7/1875 | Wheeler . | |
| 276,613 | 5/1883 | Loomis et al. . | |
| 466,345 | 1/1892 | Haberle . | |
| 572,907 | 12/1896 | Norton . | |
| 616,200 | 12/1898 | Newcomb . | |
| 825,381 | 7/1906 | Coleman . | |
| 1,369,215 | 2/1921 | Baston . | |
| 1,422,253 | 7/1922 | Brown . | |
| 1,633,800 | 6/1927 | Wilcox . | |
| 1,855,938 | 4/1932 | Collins . | |
| 2,281,499 | 4/1942 | Herzbrun et al. . | |
| 2,653,449 | 9/1953 | Stauch . | |
| 2,686,080 | 8/1954 | Wood . | |
| 2,820,671 | 1/1958 | McFarland . | |
| 2,924,422 | 2/1960 | Williams . | |
| 3,018,969 | 1/1962 | Gentry | 239/315 X |
| 3,021,983 | 2/1962 | Blocksom . | |
| 3,392,921 | 7/1968 | Demaison . | |
| 3,470,874 | 10/1969 | Accetta . | |
| 3,734,410 | 5/1973 | Bruno . | |
| 3,735,900 | 5/1973 | Gores . | |
| 3,777,982 | 12/1973 | Britton | 239/315 |
| 3,788,544 | 1/1974 | Koskinenm | 239/533.13 X |
| 3,933,308 | 1/1976 | Bradley et al. . | |
| 4,218,012 | 8/1980 | Hamza et al. . | |
| 4,240,566 | 12/1980 | Bergman et al. . | |
| 4,403,737 | 9/1983 | Hancock . | |
| 4,506,831 | 3/1985 | Ghyczy et al. . | |
| 4,767,059 | 8/1988 | Crapser et al. . | |
| 4,875,626 | 10/1989 | Buhler . | |
| 5,060,867 | 10/1991 | Luxton . | |
| 5,125,582 | 6/1992 | Surjaatmadja et al. . | |
| 5,301,877 | 4/1994 | Madison . | |
| 5,413,280 | 5/1995 | Taylor . | |
| 5,445,226 | 8/1995 | Scott et al. . | |
| 5,544,810 | 8/1996 | Horvath et al. . | |

*Primary Examiner*—Andres Kashnikow
*Assistant Examiner*—Steven J. Ganey

[57] ABSTRACT

Disclosed herein are nozzles connectable to a hose or other fluid supply. The nozzles can store an active material such as an insecticide and then dissolve it into the water from the hose. The nozzle has an elongated cylindrical outer housing. A sleeve is positioned in the housing which stores the active material. An interaction between a cap and a valve controls the valve on/off operation and also a rinse by-pass in response to rotation of the housing relative to a knob. After the liquid passes into the sleeve, it travels a serpentine path before it reaches the outlet of the housing. This, along with a particle trap and a swirl chamber, provides a relatively consistent solution concentration.

11 Claims, 8 Drawing Sheets

NOZZLE TO DISPENSE ACTIVE MATERIAL

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to a nozzle for delivering an active material diluted with water from a fluid supply (e.g. a conduit such as a garden hose). The active material can be formulated for insect control, weed control, cleaning, fertilizing, or the like. More particularly, it relates to a nozzle that also stores the active material.

Various systems have been developed to use water in a hose to aspirate/integrate an active material into the fluid line to deliver insecticides, herbicides, fertilizers, automobile cleaners, window cleaners, fire retardants, disinfectants, anti-fogging compounds, pool care compounds, and other cleaning, disinfecting, and deodorizing materials (collectively "active material(s)"). The active material is typically formulated and stored in a concentrated liquid form in a separate container prior to use. The dispensing system then requires the concentrate to be aspirated/integrated with the water supply. This results in a series of complex internal and external connections to allow the device to aspirate and dispense properly.

Other systems have been developed to dilute and deliver an active material from a hose or the like where the nozzle itself stores the active material. See e.g. U.S. Pat. Nos., 165,773; 4,767,059; and 4,875,626. The disclosures of these patents and all other publications referred to herein are incorporated by reference as if fully set forth herein.

However, piston based systems used for this purpose can be complex and difficult to manufacture, thus becoming costly to produce. Also, since they are designed only for liquid forms of active materials, they are unsuitable for use with solid/semi-solid (gel) forms of active materials. Solid/semi-solid active materials are preferred as they require less space in a container, are lighter weight so as to be easier to transport, and provide a longer period of application per gram then their liquid counterparts. Systems that are more suitable for use with solids have in the past provided uneven dispensing of the active material, are susceptible to blockage, are bulky in construction and/or have other deficiencies.

There is therefore a need for an improved hose-end nozzle that stores and dispenses an active material.

BRIEF SUMMARY OF THE INVENTION

The invention provides a nozzle assembly that can be connected to a fluid supply and is suitable for diluting an active material storable in the nozzle with a liquid delivered by the fluid supply. There is an elongated housing having an inlet adjacent one end, an outlet adjacent an opposite end, and an internal axial bore extending therebetween. There is also a sleeve inserted in the axial bore, the sleeve having an internal receptacle section suitable to receive the active material to be diluted and an upstream inlet for permitting the liquid to enter the receptacle.

A cap is positioned adjacent the upstream sleeve inlet for directing the liquid into the sleeve when the nozzle is in an open position and is connected to a supply of liquid. A valve is positioned adjacent the cap so that in a first position it can restrict flow of liquid through the cap, and so that in a second position it can permit flow of liquid through the cap.

There are also means for causing axial movement of the cap relative to the valve (to effect the open/close function), and means (e.g. threads, bayonet connection, snap fit, or the like) adjacent an upstream end of the nozzle permitting the connection of a hose to the nozzle.

The housing and sleeve are configured and juxtaposed such that after the liquid contacts the active material the resulting solution travels a serpentine path to exit the nozzle. By serpentine, we mean that the pathway undergoes a direction change of more than 90 (preferably more that 145) degrees at least twice after contacting the active material.

Preferably, the nozzle has a knob positioned around the housing. The knob is interfitted with the housing by a projection and recess connection. Rotation of the housing while holding the knob steady causes axial movement therebetween. In one embodiment this is due to a camming interaction between the recess and projection. This provides the open/close control of the valve.

The sleeve preferably has a flange with small (preferably kidney shaped) openings. These openings limit the size of undissolved active material pieces which can reach the downstream end of the housing. If any undissolved chunks of active material are propelled by the water out of the sleeve, they will thus not be able to enter the space between the sleeve and outer housing due to this trapping structure. They will either fall back into the sleeve (until they are sufficiently broken up or dissolved), or be further dissolved and/or broken up adjacent the openings.

There can also be a swirl chamber adjacent a downstream end of the sleeve. This provides a further opportunity to mix active material and liquid prior to the solution exiting the nozzle assembly. The active material is preferably in solid form and selected from the group consisting of insecticides, insect repellents, pesticides, herbicides, fertilizers, surfactants, and fire retardants.

Suitable insecticides include pyrethroids such as cyfluthrin, cyhalothrin, and allethrin, carbamates such as bendiocarb and carbaryl, organophosphates such as chlorpyrifos, diazinon and azinphosmethyl, pyrazoles such as fipronil, organochlorines such as methoxychlor, organosulfurs such as propargite, formamidines such as amitraz, botanicals such as d-limonene, Neem, and pyrethrum, acylureas such as hexaflumuron, flufenoxuron, and diflubenzuron, soaps, and synergists such as piperonyl butoxide and MGK264[7], antibiotics such as Abamectin and Avermectin $B_1$, insect growth regulators such as hydroprene, methoprene, and fenoxycarb, microbials such as bacteria (e.g. *Bacillus thuringiensis*), viruses (e.g. Heliothis nuclear polyhedrosis virus), fungi (e.g. *Metarhizium anisopliae*), protozoa (e.g. *Nesema locustae*), and nematodes (e.g. *Neoaplectana carpocapsea*).

Suitable nematacides include organophosphates such as fenaminphos and disulfoton, and carbamates such as phorate.

Suitable repellents to include dimethyl phthalate, citronella, citronella oil, and DEET and repellent insecticides such as permethrin, azadiractin, and Neem oil.

Suitable herbicides include acetanilides such as alachlor, amides or substituted amides such as propanil, benzoics such as chloramben, benzothiadiazoles such as bentazonbipyridliums such as paraquat, carbanilates such as propham, chlorinate aliphatic acid such as TCA and dalapon, cyclohexenones such as sethoxydim, nitroantilines such as prodiamine, dinitrophenols such as diniseb, diphenyl ethers such as acifluorfen, imidazoles such as imiazapyr, oxyphenoxy acid esters such as fluazifopbutyl, petroleum oils, phenox acids such as 2,4-D, phenylureas or substitutes ureas such as fluometuron, phosphono amino acids such as glyphosate, phthalic acids such as chlorothal, pyridazinones and pyridinones such as pyrazon, pyridinoxy and picolinic acids, picloram, soaps such as the fatty acid salts (e.g. lauric acid), sufonylureas such as chlorsulfuron, thiocarbarnates such as EPTC, triazines such as atrazine, and uracils or substituted uracils such as bromacil.

Suitable plant growth regulators include gibberellins such as giggane, cytokines such as adanine, ethylene generators such as ethephon, and assorted inhibitors and retardants such as cinnamic acid and abscisic acid.

Suitable defoliants and desiccants include inorganic salts, aliphatic acids, paraquat, organophosphates such as merphos, carodylic acid, phenol derivatives such as dinoseb, and bipyriydiums such as diquat.

Suitable fungicides and bactericides include inorganics such as sulfur and copper compounds, and organic compounds such as dithiocarabamates such as thiram, thiazoles such as etridaazole, substituted aeromatics and benzene derivatives such as PCNB, sulfenimides such as captan, oxzthiins such as carboxin, benzimidazoles such as benomyl, pyrimidines such as dimethirmol, phenylamines such as metalxyl, triazoles such as hexaconazole, piperazines, such as triforine, organophosphates such as fosety-al, dicaboximides such as procymidone, morpholines such as dodemorph, dinitrophenols such as dinocap, organotins such as fentin hydroxide, aliphatic nitrogens such as dodine, and antibiotics such as striptomycin.

Suitable algaecides include inorganic chlorines, copper compounds, quaternary ammonium halides, and organic compounds such as trihphenyltin acetate and endothall.

Suitable disinfectants include phenols, halogens, hypochlorites, chloroamines such as chloraine-T, heavy metals, and quaternary ammonium detergent compounds such as stearic acid monoglyceride.

Suitable fertilizers (primary, secondary, and micronutrients) include nitrogen, phosphorus, potassium, calcium, magnesium, sulfur, iron, boron, manganese, copper, zinc, molybdenum, and chlorine.

The surfactants may be anionic, cationic, nonionic, or zwitterionic, depending on the application desired. For example, a surfactant which can be used to wash automobiles is Variquat 66. Surfactants which can be used for window cleaning include Mackamide CS, Variquat 66, and Triton DF 12.

Examples of suitable retardants for use in fire fighting foams include proteins such as Ansul 3% regular protein, fluoroproteins such as 3% Ansul fluoroprotein, film-forming fluoroproteins, aqueous film-forming foams such as Ansulite 1%, alcohol-resistant foams such as Ansulite 3×3 3%, and synthetic detergents.

Other additives can also be added to control wetting, dispersion, color, useful life, and other factors. For example, we have formulated a preferred tablet for an insecticidal use with the following formulation.

| Raw Material | wt. % | Function |
|---|---|---|
| insecticide | 13.04 | active |
| synthetic amorphous silica | 16.96 | carrier |
| alkyl substituted naphthalene sulfonic acid, sodium salt | 3.00 | wetting agent |
| sodium salt of naphthalene sulfonic acid, formaldehyde concentrate | 3.00 | dispersant |
| kaolin clay | 24.00 | filler |
| lactose | 32.5 | binder |
| cellulose | 5.00 | dispersant |
| modified gum cellulose | 2.00 | dispersant |
| magnesium stearate | 0.50 | lubricant |

A tablet was made from the above formula by using the following process. We added silica to a mixer. We then melted the insecticide, while spraying the insecticide on the silica during the mixing.

The resulting mixture was then milled to finely divide it. The wetting agent was also added while mixing, as were the dispersants, and other ingredients. We then formed a tablet from the mixture using a press. We found that use of binders such as guar gum, hydroxyethylcellulose or other cellulosic ethers are preferred for many applications.

In an especially preferred form, the cap has a downstream extension that projects into the sleeve to direct the liquid. The extension has in it a one way check valve, and at a downstream end there are outlets which are directed obliquely towards the inner wall of the sleeve (so the water must first bounce off the wall before hitting the active material).

In another aspect the invention provides a method of diluting an active material and delivering the active material in diluted form. One connects the above nozzle to a fluid supply and supplies a liquid (usually water) to the nozzle, turns the nozzle to an open position, and permits liquid to flow through the nozzle.

The present invention provides a way to dissolve a solid or semi-solid (gel) active material in a controlled manner. The concentration of active material delivered from the nozzle can remain remarkably constant (as long as active material remains in the sleeve bore). This is due to the serpentine path, the oversized particle traps, the swirl chamber, the outlet direction on the cap extension, and other aspects of the design.

In another embodiment, the knob can be rotated to at least three positions relative to the housing. One position is for preventing liquid from passing through the nozzle assembly, a second position is for permitting liquid mixed with active material to exit the nozzle assembly, and a third position is for permitting liquid not mixed with active material from exiting the nozzle assembly. This provides a rinse capability (without the need for switching nozzles).

It is a primary object of the present invention to provide a nozzle of the above kind that can store, dilute, and optionally rinse a solid or semi-solid active material.

A related object is to provide such a nozzle where the device is inexpensive to manufacture and thus suitable to be marketed as a disposable one time use unit.

It is another object to provide such a nozzle where the device is not susceptible to blockage with larger particles such that it is capable of delivering properly diluted amounts of active material.

It is another object to provide such a nozzle which also has a rinse position.

A further object is to provide methods for using such nozzles.

The foregoing and other objects and advantages of the invention will appear from the following description. The description makes reference to the accompanying drawings which form a part hereof, and in which there is shown by way of illustration the preferred embodiments of the invention. Such embodiments do not represent the fill scope of the invention. Rather, reference should be made to the claims for interpreting the full scope of the invention.

DETAILED DESCRIPTION

Figure 1:
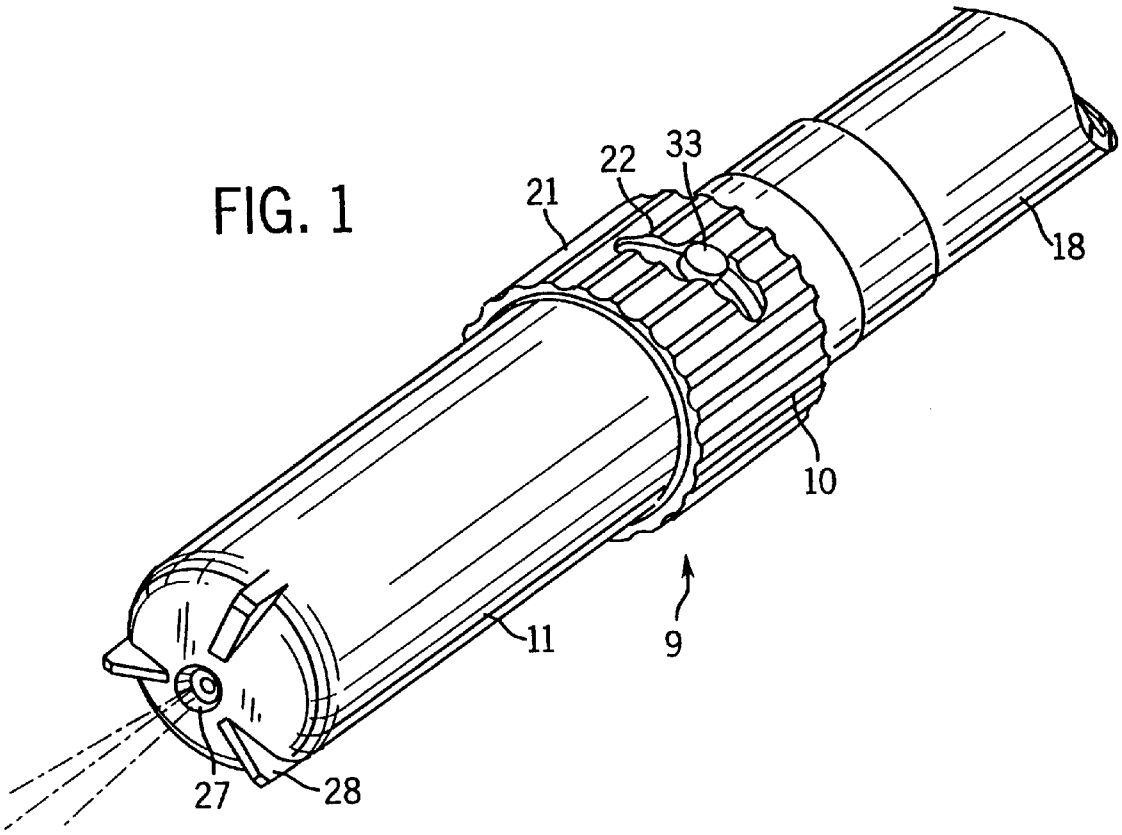
FIG. 1 is a perspective view of a nozzle of the present invention which has been attached to a garden hose.
Figure 5:
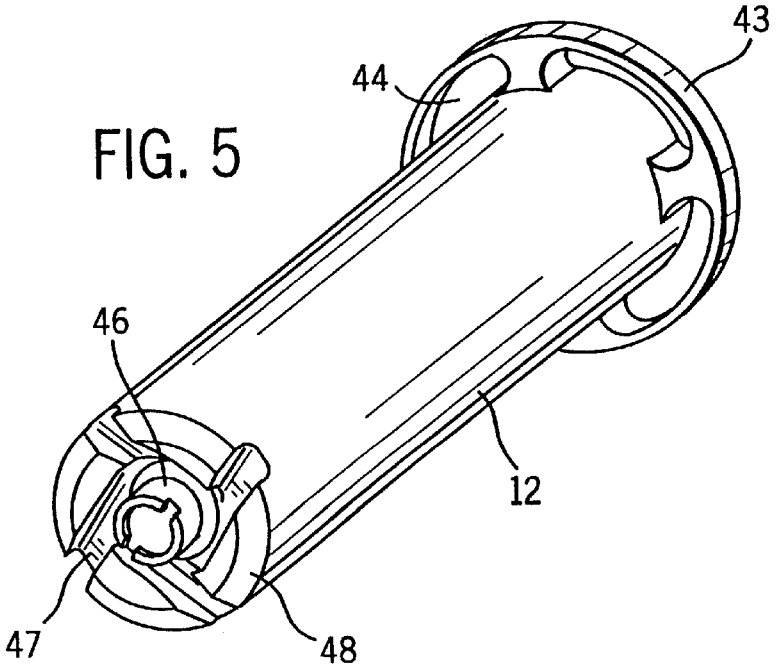
FIG. 5 is an enlarged perspective view of a sleeve of the first embodiment.

FIGS. 1–4 show the preferred nozzle assembly (generally 9) of the present invention. The main components of the nozzle assembly are knob 10, an outer housing 11, a sleeve 12, a injector cap 13, a valve assembly 14, a flow operated type check valve 15, and solid active material 16.

The check valve 15 may be of the "duckbill" type as shown, or another type of check valve may be used. For example, another type of suitable check valve is a valve having four quadrant type flaps covering its outlet. Flow through the check valve spreads the flaps downstream and permits water flow. In the event of a negative pressure upstream of the check valve, the flaps will move back upstream to form a blocking wall. The operation is similar to a duckbill operation, but uses four flaps of resilient rubber instead of two.

The nozzle may be linked to a garden hose 18 by threads 19/20. The knob 10 has grip surfaces 21 around its circumference. These are interrupted on opposite sides (preferably 180 degrees apart) of the knob by two zigzag cut outs 22 which have lobes 23 and 24 corresponding to the open and closed positions of the nozzle. The knob is preferably made of a plastic such as ABS, and is sufficiently flexible to permit the knob to be forced around housing 11 and particularly over projections 33 on housing 11.

The housing 11 is basically cylindrical. It has an outlet 27 surrounded by ribs 28 which assist in the orientation of the part during manufacture. It is preferably made of a plastic material such as polyethylene which exhibits a suitably stiff quality while resisting breakage during impact. At the upstream end of the housing 11 is an open end 34 that communicates with an internal, generally cylindrical bore 35. Cylindrical projections 33 on the opposed sides (preferably 180 degrees apart) of the housing 11 extend radially outward therefrom. They are designed to be received in the zigzag cut outs 22 to form a cam system. At the downstream end of the housing 11 the bore 35 begins to narrow. It ultimately reaches the outlet orifice 27.

Sleeve 12 is also generally cylindrical, with an internal cylindrical bore 40 extending from an upstream opening 41. It is preferably made of a plastic material such as polypropylene. At the upstream end of the sleeve 12 there is also a flange 43 extending radially from the main body. Small kidney-shaped openings 44 (preferably four openings) are formed therein. The downstream end of the sleeve 12 has an outlet post 46 surrounded by four lateral passageways 47. These structures and the housing downstream end (when assembled together) create a swirl chamber/mixing area immediately before the outlet.

Injector cap 13 has a generally cylindrical section 50 that has an inlet 51. The cap is preferably made of a plastic such as polypropylene. There is also an extension 52 with a series of trapezoidal outlets 53 directed obliquely towards the inner side wall of the sleeve. Internal ledge 54 supports the one way flow operated check valve 15 in a wedging relationship.

The central section 50 is surrounded at the upstream end by umbrella 55. The umbrella has flexible extensions 56 that snap onto the flange 43 of the sleeve 12 for assembly purposes.

The valve assembly 14 and the one way flow operated check valve 15 may be the same as those described at FIGS. 8–13 of U.S. Pat. 4,875,626. As noted above, these disclosures are incorporated by reference. These two parts are preferably made out of a rubber such as sanoprene or neoprene. Of particular interest for the valve assembly 14 are the multiple inlets 61, the central bore 62, and the outlet 63.

The nozzle is assembled as follows. The check valve 15 is first inserted into the injector cap 13 on ledge 54. The sub-assembly of the cap and check valve is then snapped onto sleeve 12 after the solid/semi-solid active material 16 is positioned in the sleeve 12. This assembly is then inserted into the housing 11 such that the sloped end 48 of the sleeve 12 abuts against surface 72 of the housing.

The valve assembly 14 is then inserted into the threaded end of knob 10. That sub-assembly is then forced around housing 11 so that projections 33 rest in zigzag recesses 22. Finally, the assembly is threaded onto a garden hose 18 using threads 19 and 20.

Figure 2A:
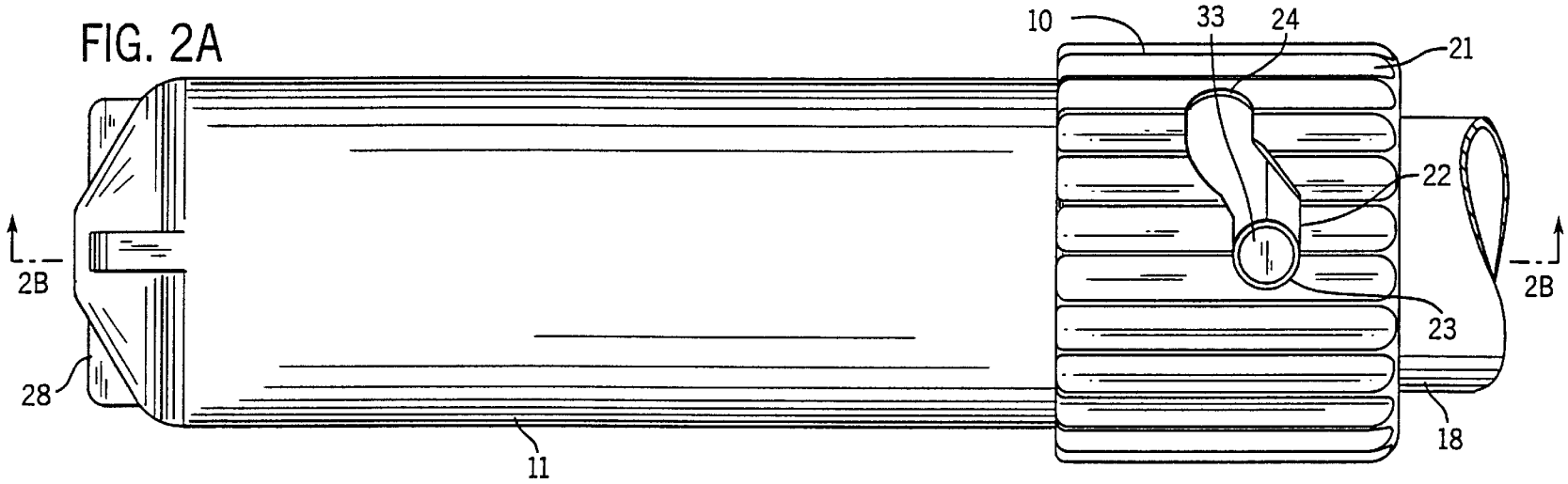
FIG. 2A is a plan view of a nozzle of the present invention, with the nozzle in the open position.
Figure 2B:
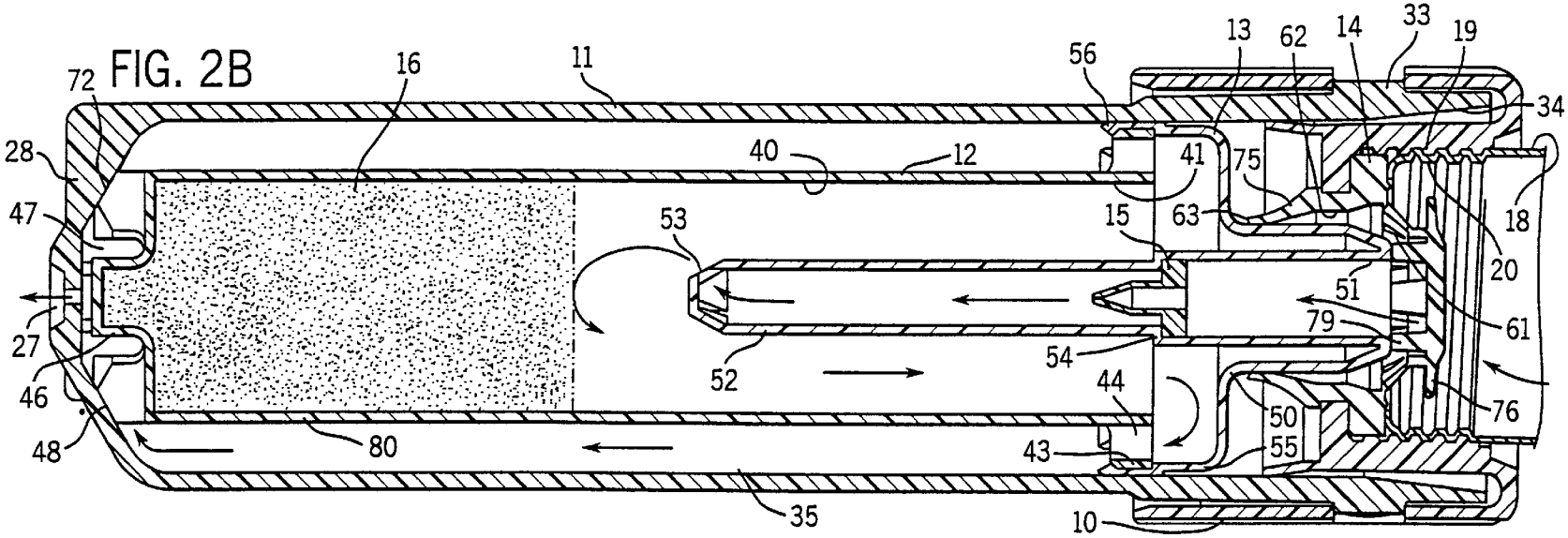
FIG. 2B is a sectional view of the nozzle of the present invention, taken on line 2B—2B of FIG. 2A.
Figure 3A:
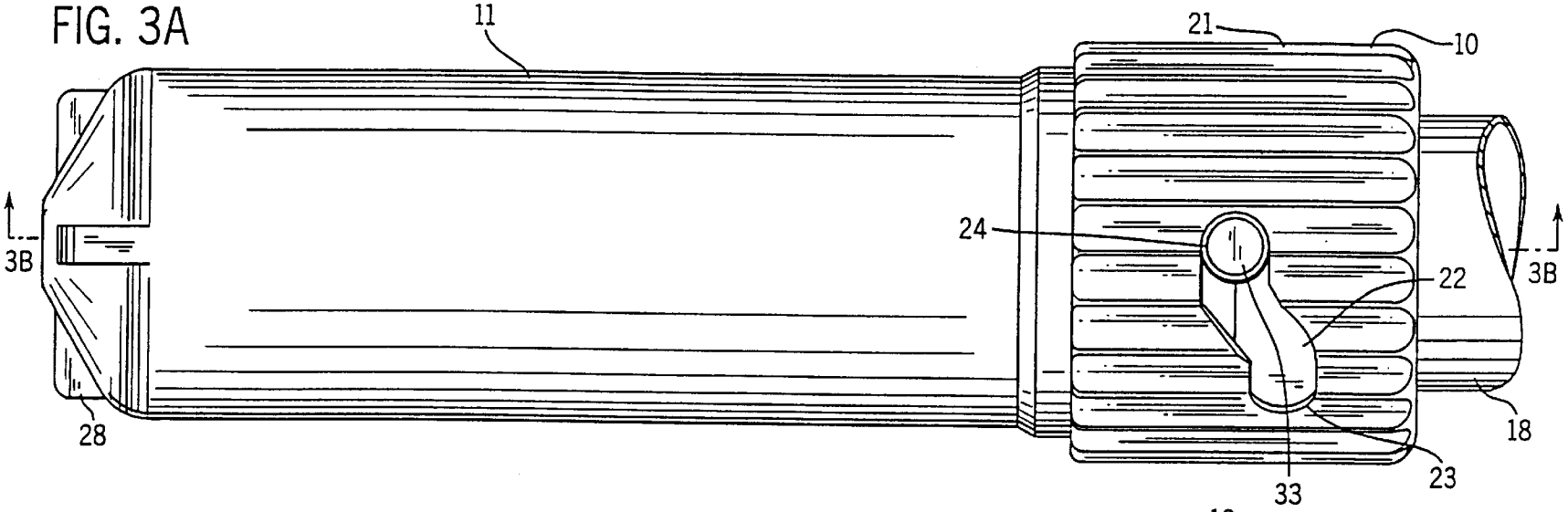
FIG. 3A is a plan view of a nozzle of the present invention, with the nozzle in the closed position.
Figure 3B:
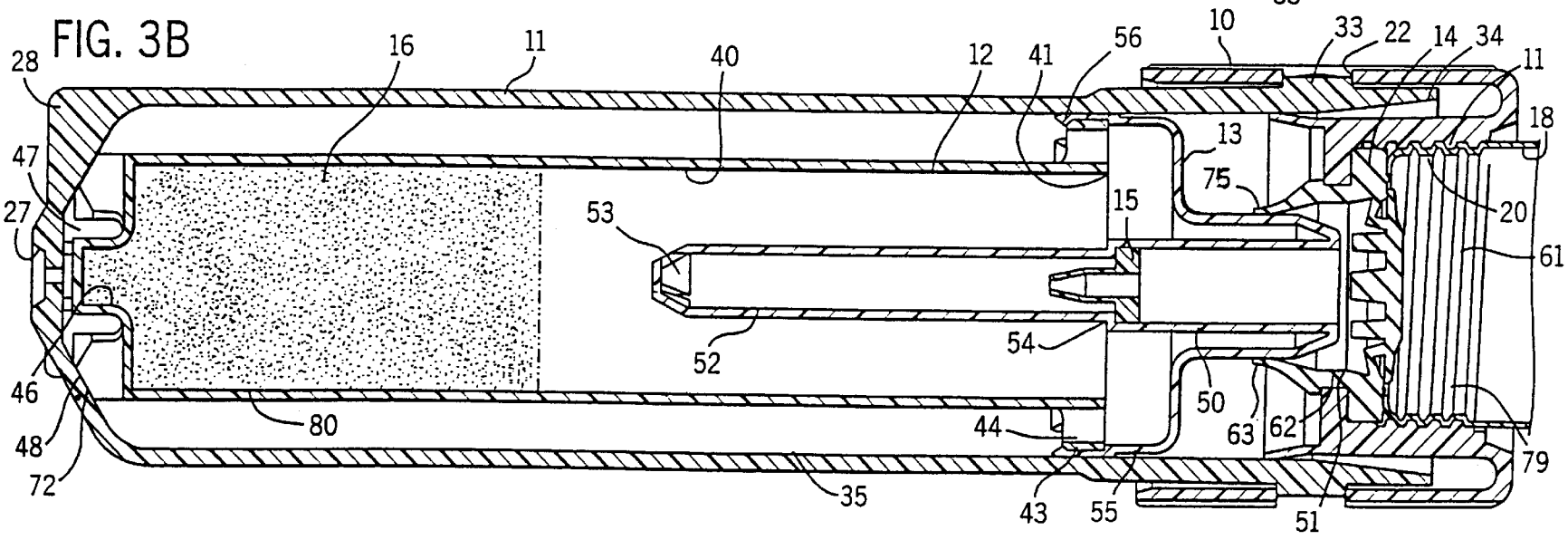
FIG. 3B is a sectional view of the nozzle of the present invention, taken on line 3B—3B of FIG. 3A.
Figure 4:
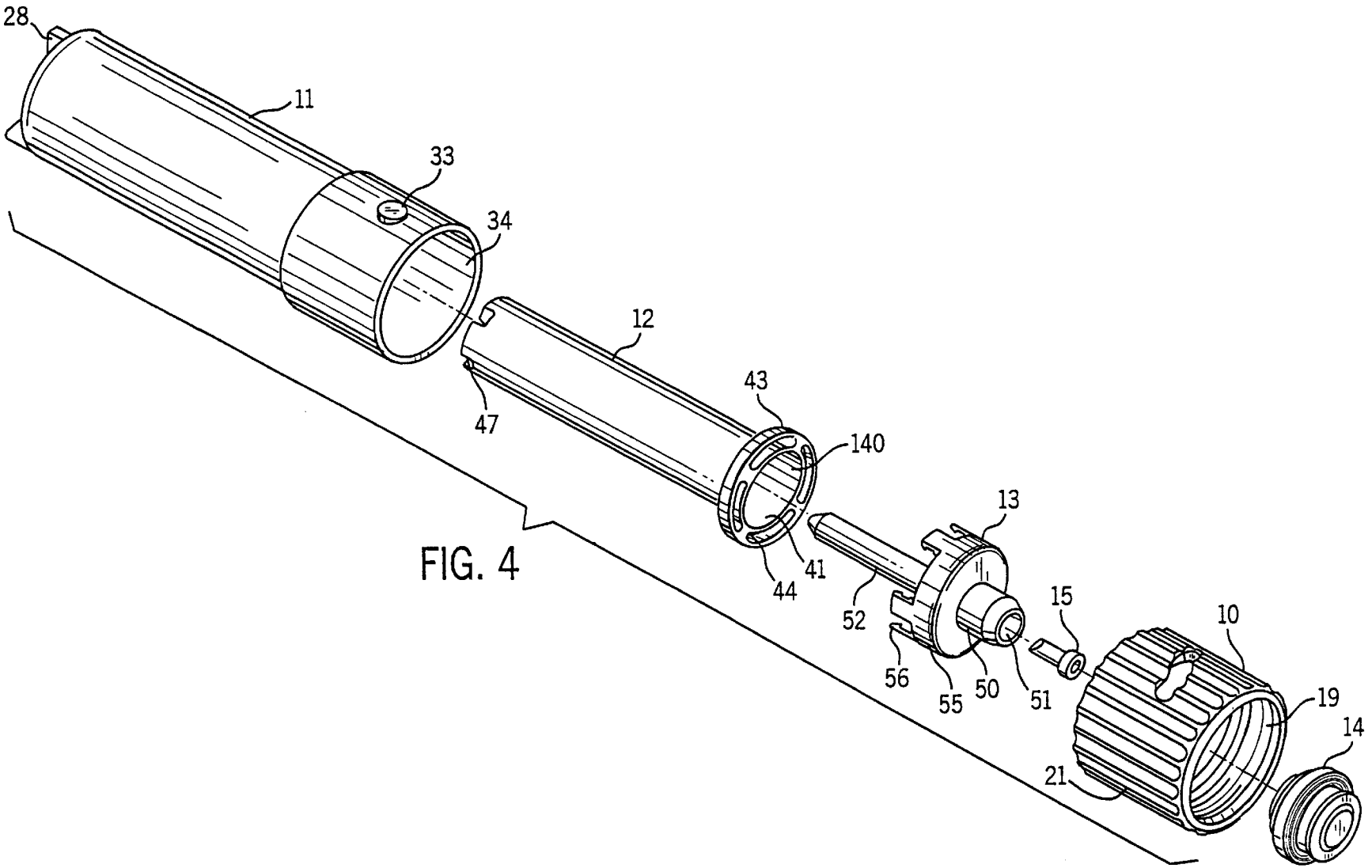
FIG. 4 is an exploded perspective view of the first embodiment of the nozzle of the present invention.

FIGS. 2A and 2B show the nozzle assembly in the open position. FIGS. 3A and 3B show the nozzle assembly in the fully closed position.

As will be appreciated by comparing FIGS. 2B and 3B (and the corresponding FIGS. 2A and 3A), rotation of the housing around its longitudinal axis, while holding the knob 10 in place, controls the open/close position of the valve. Starting with the valve in the "open" FIG. 2A position, by rotating the housing 11 projections 33 will slide along the zigzag path to alternative recesses 24. The camming effect of the walls of the recesses 22 cause the housing 11, and thus sleeve 12, injector cap 13, and check valve 15, to move axially in the downstream direction relative to the valve 14, hose 18, and knob 10. As will best be appreciated by viewing the arrows on FIG. 2B, when the valve is in the open position, water can enter the nozzle and ultimately exit via outlet 27.

Edge 75 is a flexible lip that forms a tight seal and can move axially along the cap when the housing 11 is rotated. Edge 76 is the main seal.

To open the nozzle, one rotates the housing 11 as shown in FIG. 3B in the clockwise direction to allow the projections 33 to move the knob 10 to the position shown in FIG. 2B. This will cause edge 79, where the injector cap (upstream end) and the valve 14 meet, to force the edge/lip 76 open.

Water entering the valve is directed down a central axis of the cap 13, through the one-way check valve 15, and then out the trapezoidally shaped outlets at the end of the injector cap. The force of the water is first directed against the side inner wall of the sleeve 12, not the active material. The water then bounces off the wall, albeit still with a downstream vector component.

Active material or composition 16 has been positioned in a receptacle 80 portion of sleeve 12. When placed into the sleeve, the active material forms a barrier to allow only the cross-sectional area of the active material (and surface diameter) to come into contact with the liquid source at any given time. The solution then reverses direction back around the extension portion of the injector cap 13. It then travels via another second reversal of direction. It then passes through the kidney shaped openings 44. The openings act as traps to prevent large pieces of active material from clogging the outlet or radically altering the final concentration.

The water is then directed radially inward via the four lateral channels 47. The water is forced in from the four directions around the post 46 (in a somewhat tangential manner) to create a turbulent swirl around it, thereby dissolving small pieces of active material and preventing clogging of the pathways. The water/active material mixture then exits the end of housing 11 out the exit orifice 27.

In order to turn the nozzle off one rotates the housing 11 in the counterclockwise direction (to return the knob to the position shown in FIG. 3A). This will cause edge 79 of the valve 14 to seal against the upstream end of the injector cap, allowing the pressure of the incoming liquid (preferably water) to force edge/lip 76 to seal against the valve body 14. This closes the nozzle.

When all of the active material has exited the nozzle, the garden hose can be unthreaded from the nozzle, with the entire nozzle assembly then being thrown away. This permits defined aliquots of an active material to be delivered for a particular purpose. It also permits the safe disposal of the container where the active material may be dangerous if improperly used.

If desired, the plastic materials that are used can be transparent so that a consumer can monitor the amount of active material left in the nozzle. Alternatively, a dye can be added to the active material (e.g. Acid Blue #9) which also helps to monitor whether any active material is left in the nozzle while tracing the location of the active material as it exits the nozzle.

In the second embodiment of the invention (see FIGS. 6A–9), the valve is provided with a rinse position as well. Analogous parts are referred to by the same number albeit with an additional 1 in front of it. It will be appreciated that the sleeve 112 now has an additional two projections 190 with separations 191 therebetween. The cap 113 now has two similar projections 193 with similar separations therebetween.

The projections 193 are radially spaced so as to tightly slide inside the projections 190. When the parts are assembled, this forms a valve system. In one alignment, the water is permitted to pass through separations 191 and 193. In another, the respective projections block the separations.

Figure 6A:
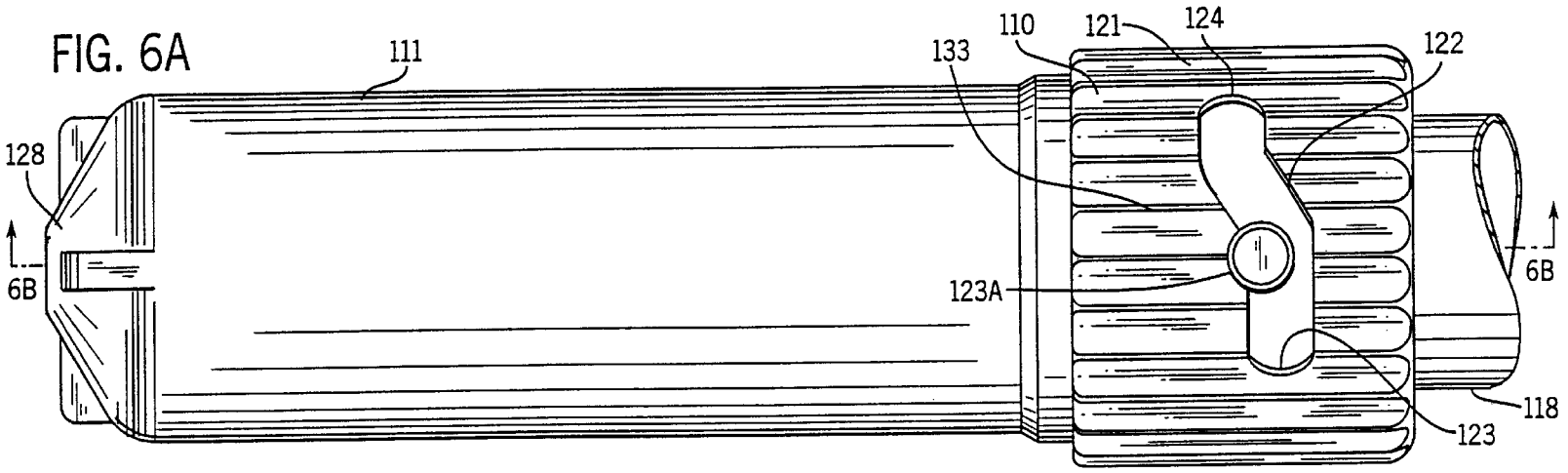
FIG. 6A is a plan view of a modified form of the nozzle of the present invention, with the nozzle in a rinse water position.
Figure 6B:
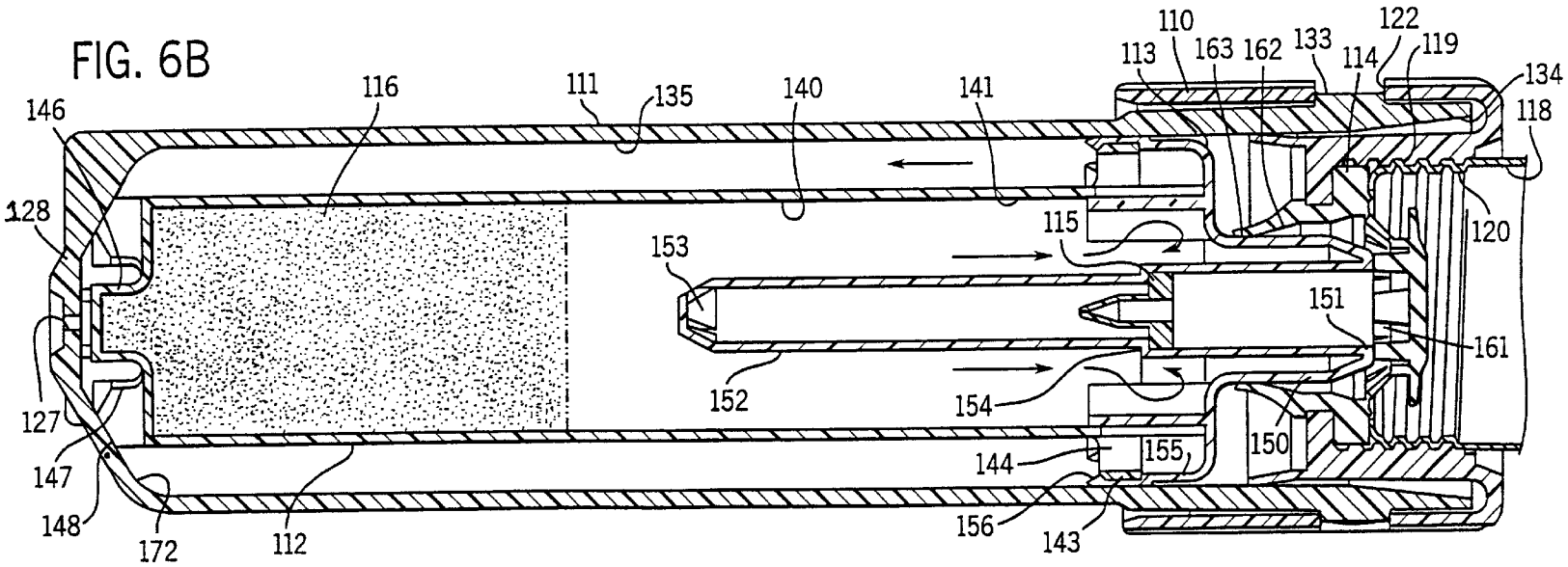
FIG. 6B is a sectional view taken on line 6B—6B of FIG. 6A.

Turning specifically to FIG. 6A, there is now shown an additional rinsing position 123A on the knob. At that position, the internal components are as shown in FIG. 6B.

Figure 7:
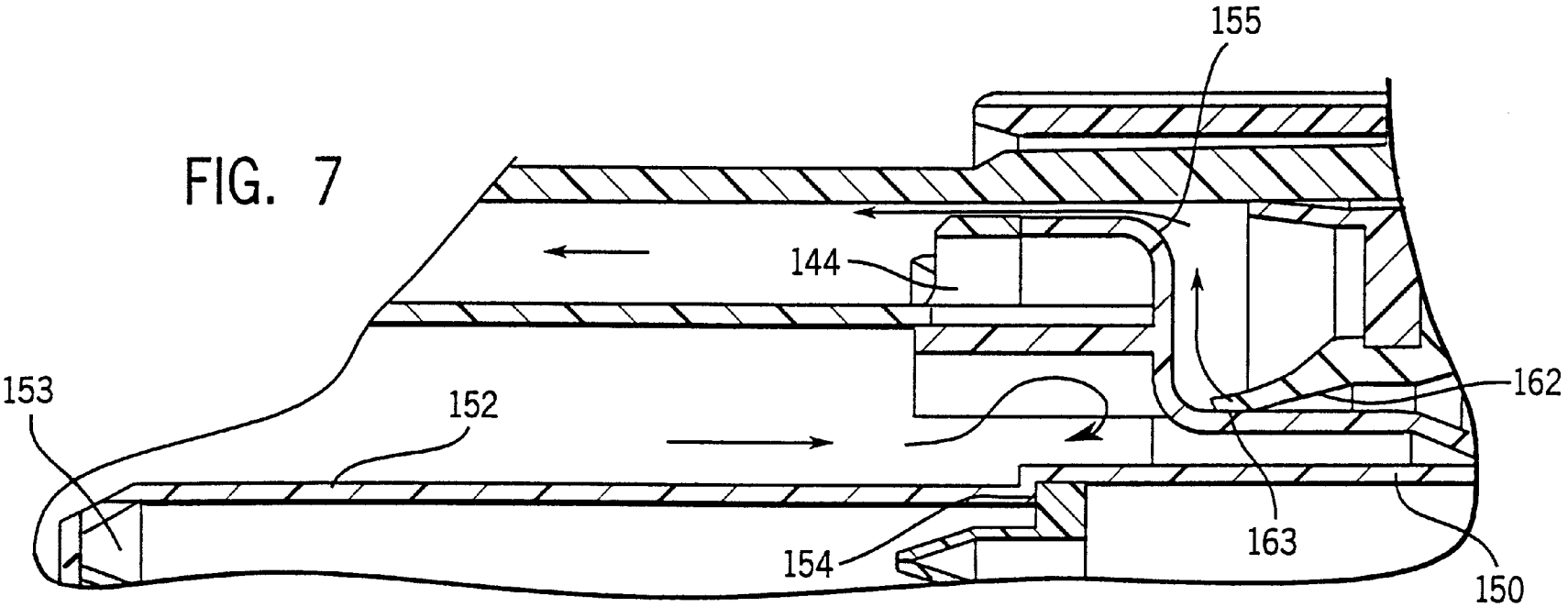
FIG. 7 is an enlarged sectional view of a portion of FIG. 6B.

It will be appreciated that in that position water can enter the cap and sleeve, but it cannot exit in the normal fashion due to the aforesaid projections blocking the separations between the other projections. As a result, and as best seen in FIG. 7, this will cause the clean water to force its way past lip 163 and outside of umbrella 155 and then down along the usual outlet path. This creates a rinse flow with no active contained in the rinse water.

Figure 8A:
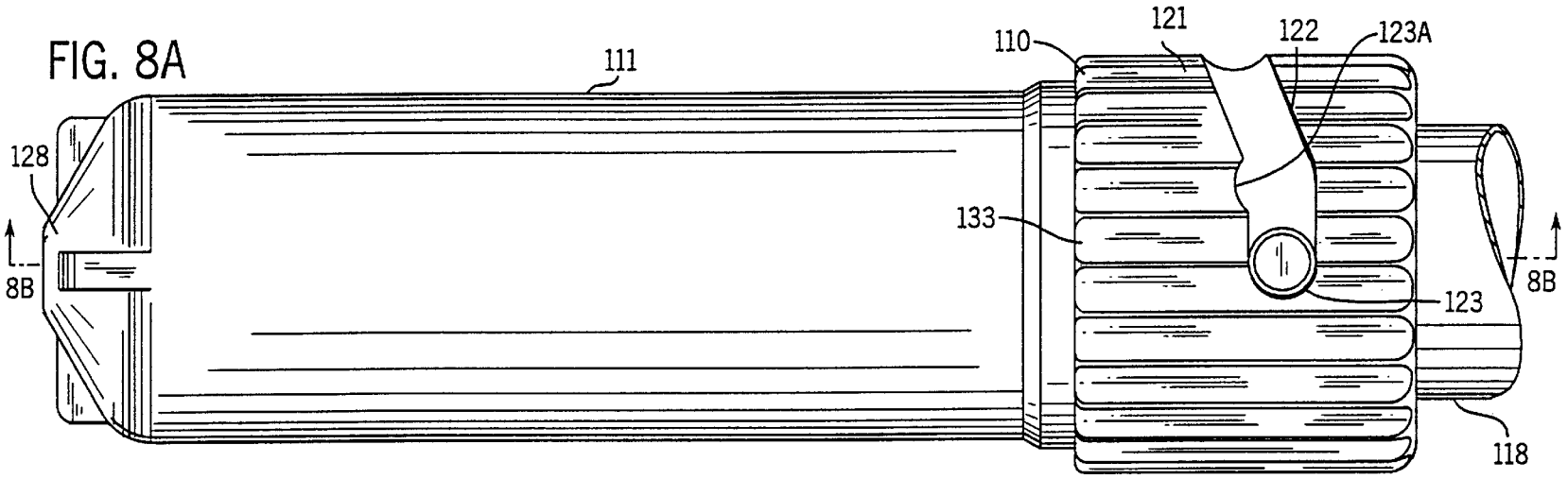
FIG. 8A is a plan view of the FIG. 6A embodiment of the present invention, albeit with the nozzle in a mixed active/water open position.
Figure 8B:
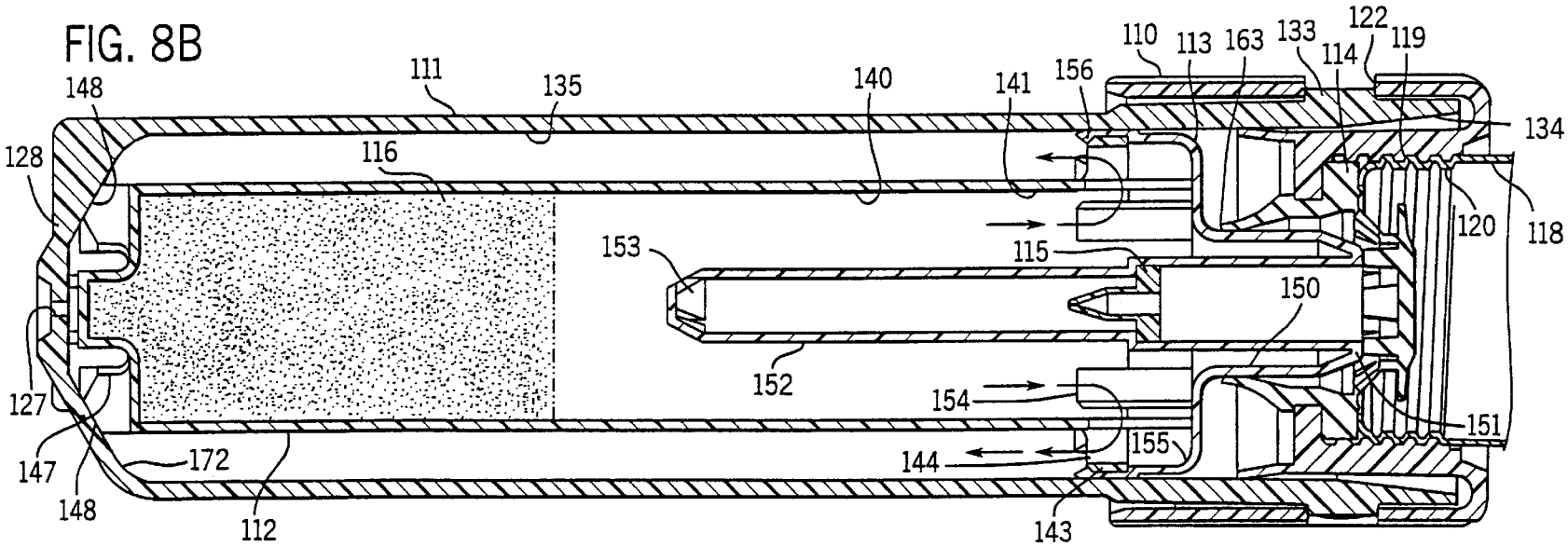
FIG. 8B is a sectional view taken on line 8B—8B of FIG. 8A.
Figure 9:
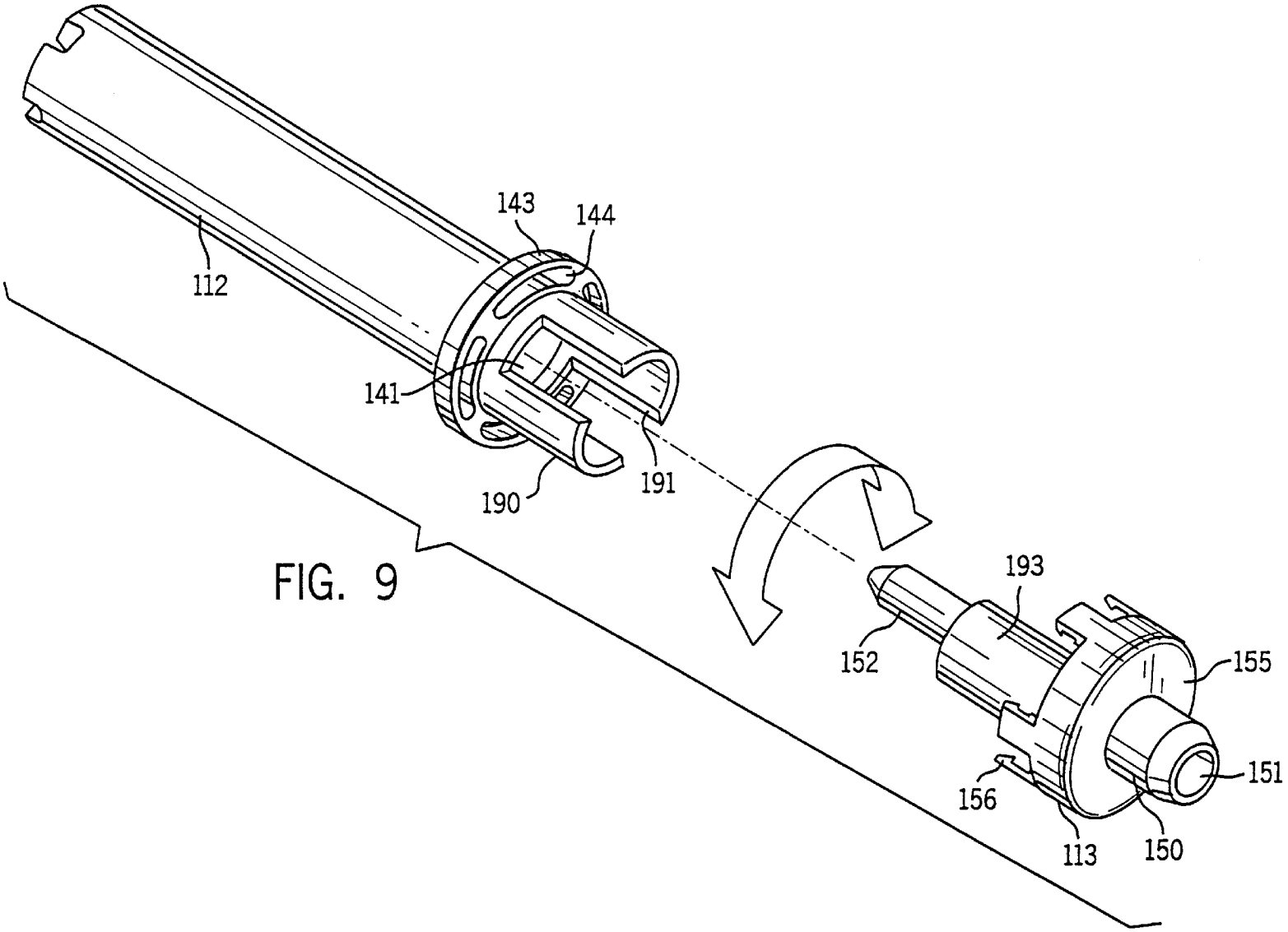
FIG. 9 is an enlarged exploded view of several components of the FIG. 6A embodiment.

By rotating the knob to the position shown in FIG. 8A, the internal parts are as shown in FIG. 8B. In this position, the respective projections on the cap and sleeve do not block the separations. Thus, mixed water and active can flow through the valve.

When the knob is rotated so that the projection 133 is in position 124 (not shown), the result will be that the seal assumes a position similar to that shown in FIG. 3B, thereby closing the valve.

The above description has been that of preferred embodiments of the present invention. It will occur to those who practice the art that modifications may be made without departing from the spirit and scope of the invention. For example, while solid active materials are highly preferred with this nozzle, the nozzle may also be used with viscous gels and other forms of active materials. Also, while the most preferred use of the nozzle is providing an insecticide that can be sprayed along the foundation of a home or the like, there are numerous other active materials and applications that are intended to be within the scope of the invention. For example, the active material could be a flea killer which is sprayed on a pet (such as a dog) during or after the activity of washing a pet.

Other intended applications include cleaning applications (e.g. window cleaners, sidewalk cleaners, wall cleaners, automobile and engine cleaners, deck and fence cleaners, animal area cleaning compositions, boat cleaners, pool cleaners, and the like) and lawn care products such as herbicides and fertilizers.

Additionally, other changes to the nozzle assembly can be made without departing from the claimed subject matter.

INDUSTRIAL APPLICABILITY

This invention has utility in providing ways to store and dispense active materials that need to be diluted as they are about to be used. It appears to be especially suitable to deliver dilute solutions of insecticides, herbicides, fertilizers, surfactants and fire retardants via a garden hose.

We claim:

1. A nozzle assembly connectible to a liquid supply for diluting an active material that is storable in the nozzle assembly with a liquid, the assembly comprising:

an elongated housing having an inlet adjacent one end, an outlet adjacent an opposite end, and an internal axial bore extending therebetween;

a sleeve inserted in the axial bore, the sleeve having an internal receptacle section suitable to receive an active material to be diluted, and an upstream inlet for permitting the liquid to enter the receptacle section;

a cap positioned adjacent the upstream sleeve inlet for directing the liquid into the sleeve when the nozzle assembly is in an open position and connected to a supply of liquid; and means adjacent an upstream end of the nozzle assembly for permitting a connection to the liquid supply;

wherein the housing and sleeve are configured and juxtaposed such that the liquid can reverse direction in the inner receptacle section so that as the liquid leaves the inner receptacle section the liquid can travel upstream, then radially outward, then downstream in a serpentine path to reach the housing outlet.

2. The nozzle assembly of claim 1, wherein the assembly further comprises:

a valve positioned adjacent the cap so that in a first position the valve can restrict flow of liquid through the cap, and so that in a second position the valve can permit the flow of liquid through the cap; and means for causing axial relative movement of the cap with respect to the valve between said first and second positions.

3. The nozzle assembly of claim 1, wherein the sleeve further comprises a flange having openings to limit the size of undissolved active material which may reach the outlet of the housing.

4. The nozzle assembly of claim 1, wherein the assembly further comprises a swirl chamber between a downstream end of the sleeve and the housing.

5. The nozzle assembly of claim 1, further comprising a solid active material positioned in the receptacle section, wherein the solid active material is selected from the group consisting of insecticide, insect repellent, pesticide, herbicide, surfactant, and fire retardant.

6. A method of diluting an active material and delivering the active material in diluted form, comprising:

connecting the nozzle assembly of claim 1 to a hose;

supplying a liquid to the hose and thus the nozzle assembly; and turning the nozzle assembly to an open position to permit the liquid to flow through the nozzle assembly and dissolve at least some of the active material.

7. The method of claim 6, comprising the further step of thereafter delivering liquid unmixed with the active material from the nozzle assembly.

8. A nozzle assembly connectible to a liquid supply for diluting an active material that is storable in the nozzle assembly with a liquid, the assembly comprising:

an elongated housing having an inlet adjacent one end, an outlet adjacent an opposite end, and an internal axial bore extending therebetween;

a sleeve inserted in the axial bore, the sleeve having an internal receptacle section suitable to receive an active material to be diluted, and an upstream inlet for permitting the liquid to enter the receptacle section;

a cap positioned adjacent the upstream sleeve inlet for directing the liquid into the sleeve when the nozzle assembly is in an open position and connected to a supply of liquid; and means adjacent an upstream end of the nozzle assembly for permitting a connection to the liquid supply;

wherein the housing and sleeve are configured and juxtaposed such that after the liquid leaves the receptacle section the liquid travels a serpentine path to reach the housing outlet;

wherein the cap has a downstream extension therefrom that extends into the receptacle section of the sleeve to direct the liquid into the sleeve at least partially radially; and wherein the cap has in it a check valve, and at a downstream end of the extension there is an outlet which is directed towards an inner wall of the sleeve.

9. A nozzle assembly connectible to a liquid supply for diluting an active material that is storable in the nozzle assembly with a liquid, the assembly comprising:

an elongated housing having an inlet adjacent one end, an outlet adjacent an opposite end, and an internal axial bore extending therebetween;

a sleeve inserted in the axial bore, the sleeve having an internal receptacle section suitable to receive an active material to be diluted, and an upstream inlet for permitting the liquid to enter the receptacle section;

a cap positioned adjacent the upstream sleeve inlet for directing the liquid into the sleeve when the nozzle assembly is in an open position and connected to a supply of liquid; and means adjacent an upstream end of the nozzle assembly for permitting a connection to the liquid supply;

wherein the housing and sleeve are configured and juxtaposed such that after the liquid leaves the receptacle section the liquid travels a serpentine path to reach the housing outlet;

wherein the assembly further comprises a knob positioned around the housing, said knob being interfitted with the housing by a projection and recess connection; and wherein the knob can be rotated to at least three positions relative to the housing, one position being for preventing the liquid from passing through the nozzle assembly, a second position being for permitting the liquid mixed with active material to exit the nozzle assembly, and a third position being for permitting the liquid not mixed with active material to exit the nozzle assembly.

10. The nozzle assembly of claim 9, wherein a rotation of the housing in the knob will cause axial movement therebetween.

11. A nozzle assembly connectible to a liquid supply for diluting an active material that is storable in the nozzle assembly with a liquid, the assembly comprising:

an elongated housing having an inlet adjacent one end, an outlet adjacent an opposite end, and an internal bore extending therebetween;

a receptacle section in communication with the internal bore which is suitable to receive an active material to be diluted;

an elongated conduit positioned in the bore and connectable to a supply of liquid for directing the liquid into the receptacle section when the nozzle assembly is in an open position; and means adjacent an upstream end of the nozzle assembly for permitting a connection to the liquid supply;

wherein the housing and receptacle section are configured and juxtaposed such that the liquid can reverse direction in the receptacle section so that as the liquid leaves the receptacle section the liquid can travel radially, then downstream in a serpentine path to reach the housing outlet.

* * * * *